US010518386B2

(12) United States Patent
Wang et al.

(10) Patent No.: US 10,518,386 B2
(45) Date of Patent: Dec. 31, 2019

(54) POLISHING PAD AND POLISHING METHOD

(71) Applicant: IV Technologies CO., Ltd., Taichung (TW)

(72) Inventors: Yu-Piao Wang, Hsinchu County (TW); I-Ping Chen, Tainan (TW)

(73) Assignee: IV Technologies CO., Ltd., Taichung (TW)

( * ) Notice: Subject to any disclaimer, the term of this patent is extended or adjusted under 35 U.S.C. 154(b) by 159 days.

(21) Appl. No.: 15/835,458

(22) Filed: Dec. 8, 2017

(65) Prior Publication Data

US 2018/0161959 A1 Jun. 14, 2018

(30) Foreign Application Priority Data

Dec. 9, 2016 (TW) ..... 105140788 A

(51) Int. Cl.

| | |
|---|---|
| ***B24B 3/34*** | (2006.01) |
| ***B24D 3/34*** | (2006.01) |
| ***B24B 55/02*** | (2006.01) |
| ***B24B 29/02*** | (2006.01) |
| ***B24B 37/24*** | (2012.01) |
| ***B24B 37/34*** | (2012.01) |
| ***B24B 37/26*** | (2012.01) |

(52) U.S. Cl.

CPC ..... *B24D 3/346* (2013.01); *B24B 29/02* (2013.01); *B24B 37/24* (2013.01); *B24B 37/26* (2013.01); *B24B 37/34* (2013.01); *B24B 55/02* (2013.01)

(58) Field of Classification Search

CPC ..... B24D 3/346; B24B 29/02; B24B 37/24; B24B 37/26; B24B 37/34; B24B 55/02

USPC ..... 451/526–539

See application file for complete search history.

(56) References Cited

U.S. PATENT DOCUMENTS

| | | | | |
|---|---|---|---|---|
| 6,225,224 | B1 | 5/2001 | Pandey et al. | |
| 6,261,851 | B1 * | 7/2001 | Li | B24B 37/0056 156/345.13 |
| 6,579,604 | B2 * | 6/2003 | Obeng | B24B 37/013 264/413 |
| 6,672,940 | B1 * | 1/2004 | Graham | B24B 37/015 451/344 |
| 6,685,539 | B1 * | 2/2004 | Enomoto | B24B 7/228 257/E21.237 |

(Continued)

FOREIGN PATENT DOCUMENTS

| | | |
|---|---|---|
| CN | 101094749 | 12/2007 |
| CN | 102171001 | 8/2011 |

(Continued)

OTHER PUBLICATIONS

"Office Action of China Counterpart Application", dated Aug. 5, 2019, p. 1-p. 11.

*Primary Examiner* — George B Nguyen
(74) *Attorney, Agent, or Firm* — JCIPRNET

(57) ABSTRACT

A polishing pad is provided. The polishing pad, suitable for a polishing procedure using a slurry containing water, includes a polishing track region and a first reactant. The polishing track region includes a central region and a peripheral region surrounding the central region. The first reactant is disposed in the central region of the polishing track region, wherein the first reactant is able to react endothermically with the water in the slurry.

43 Claims, 4 Drawing Sheets

(56) References Cited

U.S. PATENT DOCUMENTS

| | | | | |
|---|---|---|---|---|
| 6,818,301 | B2 * | 11/2004 | Obeng | B24B 37/042 428/411.1 |
| 7,153,191 | B2 * | 12/2006 | Naik | B24B 53/017 451/8 |
| 8,172,641 | B2 | 5/2012 | Ho et al. | |
| 8,348,719 | B2 | 1/2013 | Lu et al. | |
| 2002/0077034 | A1 | 6/2002 | Tolles | |
| 2002/0189169 | A1 * | 12/2002 | Costas | C09G 1/02 51/307 |
| 2005/0000941 | A1 | 1/2005 | Ward | |
| 2008/0233839 | A1 | 9/2008 | Lu et al. | |
| 2015/0273655 | A1 | 10/2015 | Allison et al. | |

FOREIGN PATENT DOCUMENTS

| | | |
|---|---|---|
| CN | 104759995 | 7/2015 |
| CN | 105331979 | 2/2016 |
| EP | 1588802 | 10/2005 |
| TW | 200301176 | 7/2003 |
| TW | 201037064 | 10/2010 |
| TW | 201632305 | 9/2016 |
| WO | 0243940 | 6/2002 |

* cited by examiner

POLISHING PAD AND POLISHING METHOD

CROSS-REFERENCE TO RELATED APPLICATION

This application claims the priority benefit of Taiwan application serial no. 105140788, filed on Dec. 9, 2016. The entirety of the above-mentioned patent application is hereby incorporated by reference herein and made a part of this specification.

BACKGROUND OF THE INVENTION

Field of the Invention

The invention relates to a polishing pad and a polishing method, and in particular, a polishing pad of which a temperature distribution is changed during a polishing procedure and a polishing method using the polishing pad.

Description of Related Art

In the manufacturing process of industrial devices, the polishing process is currently the more commonly used technique to planarize the surface of an object to be polished. During the polishing process, a slurry is selected to be provided between the object surface and the polishing pad, and planarization is performed through mechanical friction generated by relative motion between the object and the polishing pad. However, the heat generated by friction during the polishing process changes the temperature of the polishing pad.

Currently, U.S. Pat. Nos. 6,225,224 and 8,172,641 disclose methods of controlling the temperature generated in the polishing process by adding or modifying the equipment. However, when working with other equipment, not only the cost of the polishing process is increased, but the assembly is also more complicated. Moreover, U.S. Pat. No. 8,348,719 discloses a method of controlling the temperature generated in the polishing process by including a reactant that results in endothermic reaction in the polishing pad. However, according to the disclosure of U.S. Pat. No. 8,348,719, the reactant and the formed product must be inert with respect to the slurry, which to a certain extent limits the combination and selection of the reactant and the slurry and leads to undesirable applicability.

Therefore, there is still demand for providing means for changing the temperature distribution generated in the polishing process for the industry to choose from.

SUMMARY OF THE INVENTION

The invention provides a polishing pad and a polishing method that reduce a temperature gradient of the polishing pad or change a temperature distribution of the polishing pad during a polishing procedure and have excellent applicability.

The polishing pad of the invention is suitable for a polishing procedure using a slurry containing water and includes a polishing track region and a first reactant, wherein the polishing track region includes a central region and a peripheral region surrounding the central region, and the first reactant is disposed in the central region of the polishing track region, wherein the first reactant reacts endothermically with the water in the slurry.

The polishing pad of the invention is suitable for a polishing procedure using a slurry containing water and includes a polishing track region and a non-polishing track region, wherein the polishing pad satisfies at least one of the following conditions: (a) a first reactant is disposed in the polishing track region, wherein the first reactant reacts endothermically with the water in the slurry, and (b) a second reactant is disposed in the non-polishing track region, wherein the second reactant reacts exothermically with the water in the slurry.

The polishing pad of the invention is suitable for a polishing procedure using a slurry containing water and includes a polishing track region including a central region and a peripheral region surrounding the central region, wherein the polishing pad satisfies at least one of the following conditions: (c) a first reactant is disposed in the central region of the polishing track region, wherein the first reactant reacts endothermically with the water in the slurry, and (d) a second reactant is disposed in the peripheral region of the polishing track region, wherein the second reactant reacts exothermically with the water in the slurry.

The polishing pad of the invention is suitable for a polishing procedure using a slung containing water and satisfies at least one of the following conditions: (e) a first reactant is disposed in the polishing pad, wherein the first reactant reacts endothermically with the water in the slurry, and (f) a second reactant is disposed in the polishing pad, wherein the second reactant reacts exothermically with the water in the slurry.

The polishing method of the invention is suitable for polishing an object and includes the following steps: providing a polishing pad, wherein the polishing pad is any one of the polishing pads described above; applying a pressure to the object to press the object on the polishing pad; and providing relative motion to the object and the polishing pad to perform the polishing procedure.

In light of the above, in the polishing pad of the invention, by including the first reactant which reacts endothermically with water and/or including the second reactant which reacts exothermically with water, the temperature gradient of the polishing pad is reduced or the temperature distribution of the polishing pad is changed during the polishing procedure. On the other hand, since the polishing pad of the invention is suitable for any polishing procedure using a slurry containing water, the polishing pad may be directly applied in the existing polishing process. Accordingly, without need to add or modify any equipment and without limitation on the combination and selection of the slurry, the temperature gradient of the polishing pad of the invention can be effectively reduced during the polishing procedure, and the polishing pad of the invention thus exhibits excellent industrial applicability.

To provide a further understanding of the aforementioned and other features and advantages of the disclosure, exemplary embodiments, together with the reference drawings, are described in detail below.

DESCRIPTION OF THE EMBODIMENTS

Figure 1:
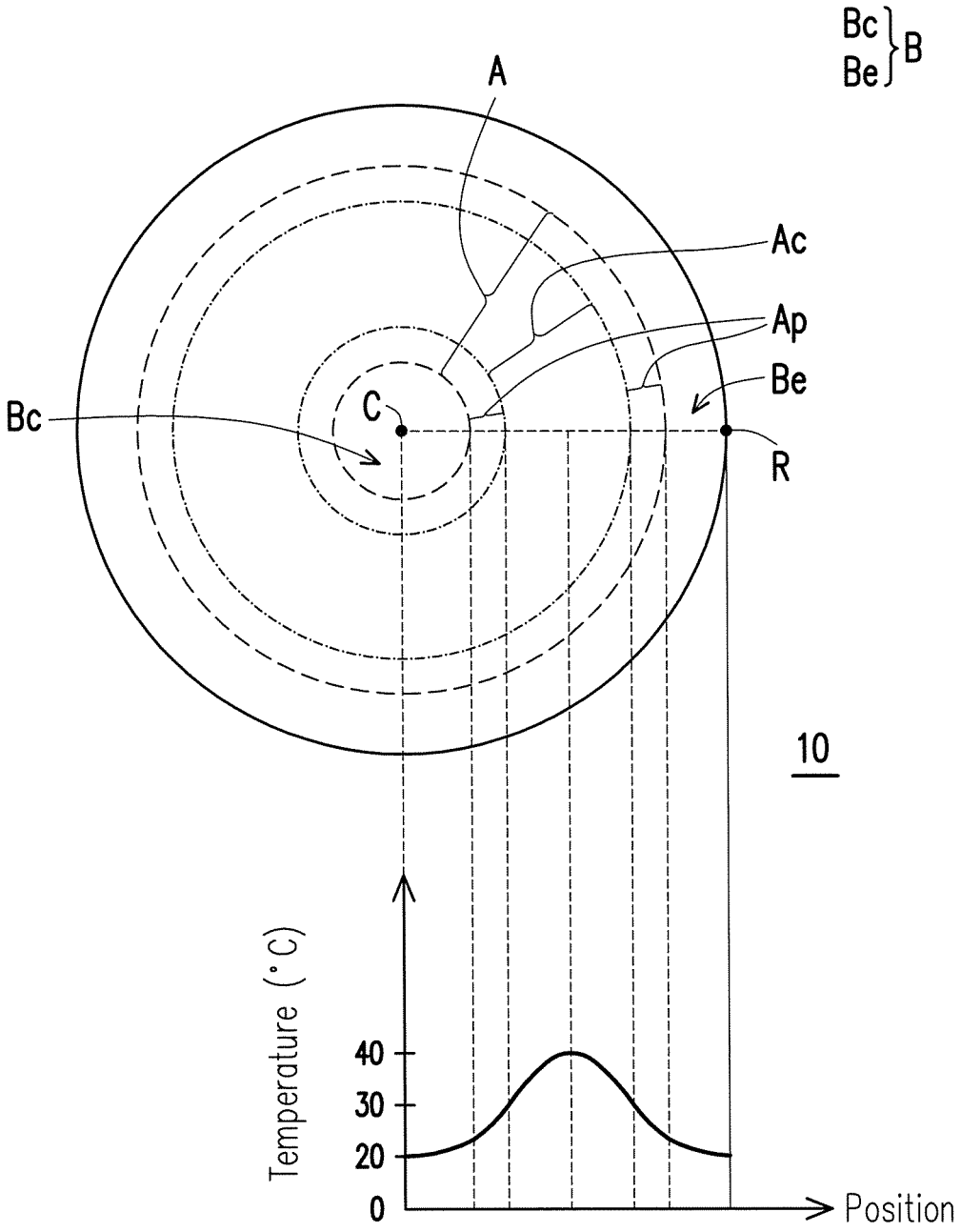
FIG. 1 illustrates a top schematic diagram of a polishing pad according to an embodiment of the invention and a corresponding conventional temperature distribution diagram obtained when a polishing procedure is performed.

FIG. 1 illustrates a top schematic diagram of a polishing pad according to an embodiment of the invention. Referring to FIG. 1, a polishing pad 10 includes a polishing track region A and a non-polishing track region B. The polishing track region A includes a central region Ac and a peripheral region Ap surrounding the central region Ac. The non-polishing track region B includes a center region Bc and an edge region Be, wherein the center region Bc is located on an inner side of the polishing track region A, and the edge region Be is located on an outer side of the polishing track region A. It is noted that when the polishing pad 10 is used to perform a polishing procedure on an object, the object is substantially placed in the polishing track region A. When the polishing procedure is performed, relative motion between the object and the polishing pad 10 causes the polishing track region A to be in an annular distribution, and the relative motion is, for example, clockwise or counter-clockwise rotation of the polishing pad 10.

FIG. 1 also illustrates a conventional temperature distribution diagram corresponding to relative positions of the polishing pad 10 of the invention obtained by using a conventional polishing pad to perform a polishing procedure. The inventors have found that the temperature distribution of the conventional polishing pad is not uniform during the polishing procedure when the conventional polishing pad is used to perform the polishing procedure on the object. Specifically, as shown in FIG. 1, during the polishing procedure, the temperature distribution of the conventional polishing pad is similar to the normal distribution along a radius direction from a rotation center C to an edge position R. More specifically, a temperature corresponding to the polishing track region A is higher than a temperature corresponding to the non-polishing track region B, and a temperature corresponding to the central region Ac of the polishing track region A is higher than a temperature corresponding to the peripheral region Ap of the polishing track region A, such that a temperature gradient (i.e., a difference in temperature) exists between different regions. In the conventional temperature distribution diagram illustrated in FIG. 1, a highest temperature corresponding to the central region Ac of the polishing track region A is about 40° C., which is a temperature obtained under a specific polishing process and conditions. However, under different polishing processes and conditions, the highest temperature may be different and may be, for example, 30° C., 35° C., 45° C., 50° C., 55° C., 60° C., or another temperature higher than the temperature corresponding to the non-polishing track region B.

As shown in the conventional temperature distribution diagram corresponding to the relative positions of the polishing pad 10 of the invention, during the polishing procedure, the central region Ac of the polishing track region A usually exhibits the highest temperature. Therefore, as long as the temperature corresponding to the central region Ac is lowered, the temperature gradient will be reduced and the temperature distribution of the polishing pad 10 will be more uniform. In an embodiment of the invention, the polishing pad 10 includes a first reactant disposed in the central region Ac of the polishing track region A, wherein the first reactant reacts endothermically with water in a slurry, which reduces the temperature gradient and causes the distribution of the polishing pad 10 is more uniform. Specifically, according to different needs of the polishing process, a second reactant is selected to be disposed in the peripheral region Ap of the polishing track region A of the polishing pad 10, wherein the second reactant reacts exothermically with the water in the slurry. Alternatively, the first reactant is selected to be disposed in the peripheral region Ap of the polishing track region A, wherein the first reactant reacts endothermically with the water in the slurry. Moreover, according to different needs of the polishing process, the second reactant is further selected to be disposed in the non-polishing track region B of the polishing pad 10, wherein the second reactant reacts exothermically with the water in the slurry. The first reactant includes components such as $NH_4NO_3$, $NH_4Cl$, urea, or xylitol, and the second reactant includes components such as CaO, $CaC_2$, ethanol, or glycerol, but the invention is not limited hereto. Therefore, the temperature gradient is reduced during the polishing procedure and the temperature distribution of the polishing pad 10 is more uniform, and the polishing pad 10 is suitable for any polishing procedure using a slurry containing water. The detailed configurational structure and material selection and properties of the polishing pad 10 of the invention will be detailed below in the embodiments corresponding to the drawings and other embodiments.

To reduce the temperature gradient and cause the temperature distribution of the polishing pad is more uniform during the polishing procedure, or to change the temperature distribution of the polishing pad during the polishing procedure, a plurality of embodiments detailing the polishing pad of the invention are provided below as exemplary embodiments for the invention to be implemented accordingly.

Figure 2:
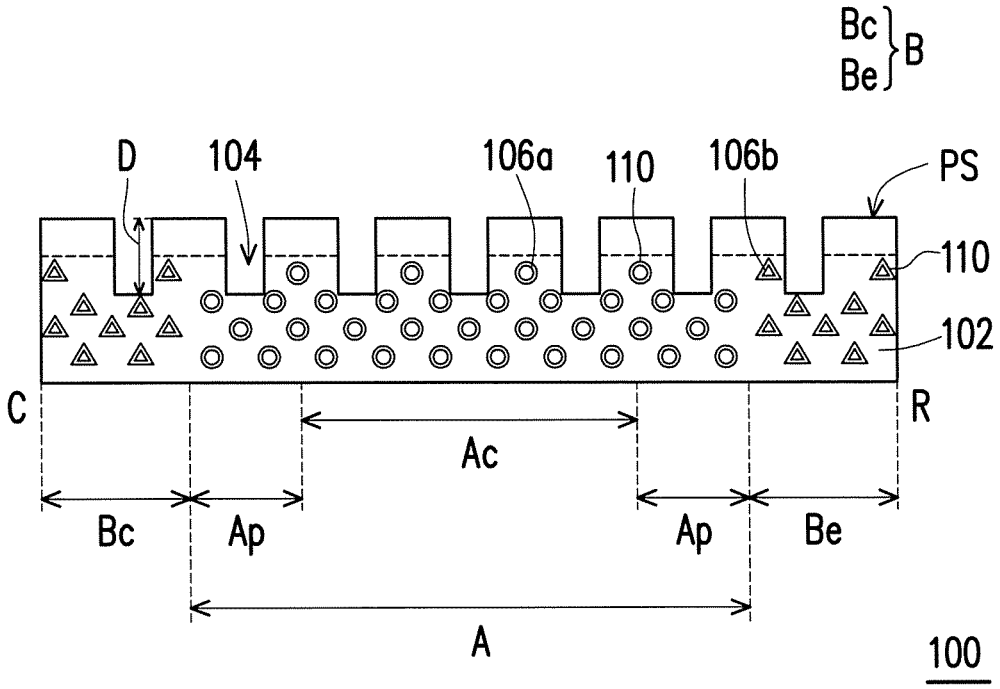
FIG. 2 is a cross-sectional schematic diagram illustrating a polishing pad along a radius direction according to an embodiment of the invention.

FIG. 2 is a cross-sectional schematic diagram illustrating a polishing pad along a radius direction according to an embodiment of the invention. In a polishing pad 100 of FIG. 2 and the polishing pad 10 of FIG. 1 above, the same or similar components are labeled by the same or similar numerals. Therefore, relevant descriptions will not be repeated here. Moreover, reference may be made to FIG. 1 for a top schematic diagram of the polishing pad 100 of FIG. 2. In other words, in the polishing pad 100, the polishing track region A surrounds the center region Bc of the non-polishing track region B, and the edge region Be of the non-polishing track region B surrounds the polishing track region A. In addition, in the embodiment of FIG. 2, although the non-polishing track region B of the polishing pad 100 simultaneously includes the center region Bc and the edge region Be, the invention is not limited hereto. In other embodiments, the non-polishing track region B of the polishing pad 100 may include the center region Bc only or the edge region Be only.

Referring to FIG. 2, a first reactant **106*a* and a second reactant 106*b* are disposed in the polishing pad 100. Specifically, in the present embodiment, the first reactant 106*a* is disposed in the polishing track region A, and the second reactant 106*b* is disposed in the non-polishing track region B. In other words, in the present embodiment, the central region Ac and the peripheral region Ap are disposed with the first reactant 106*a*, and the center region Bc and the edge region Be are disposed with the second reactant 106*b***.

In the present embodiment, the first reactant 106*a* reacts endothermically with water, and the second reactant 106*b* reacts exothermically with water. In an embodiment, the first reactant 106*a* includes components such as $NH_4NO_3$, $NH_4Cl$, urea, or xylitol, but the invention is not limited hereto. In an embodiment, the second reactant 106*b* includes components such as CaO, $CaC_2$, ethanol, or glycerol, but the invention is not limited hereto. It is noted that according to the needs, a cover layer 110 is selectively formed to cover the first reactant 106*a* and the second reactant 106*b*, wherein the cover layer 110 is used to prevent the first reactant 106*a* and the second reactant 106*b* from reacting with a precursor of a polishing layer 102 (i.e., a material for manufacturing the polishing layer 102), and the cover layer 110 does not block permeation of water. The cover layer 110 is, for example, a water-soluble material, a water-absorbing material, or a water-permeable material, such as polylactic acid, polyvinyl alcohol, polyacrylic acid, celluloses, or starch, but the invention is not limited hereto.

Moreover, in the present embodiment, the polishing layer 102 is, for example, made of polymer base materials such as polyester, polyether, polyurethane, polycarbonate, polyacrylate, polybutadiene, or another polymer base material synthesized from suitable thermosetting resins or thermoplastic resins, but the invention is not limited hereto. In an embodiment, a manufacturing method of the polishing pad 100 includes, for example: after respectively forming a structural part corresponding to the polishing track region A and a structural part corresponding to the non-polishing track region B, bonding and combining the two structures, wherein the two structures are joined by an adhesive or thermal fusion, for example. In another embodiment, the manufacturing method of the polishing pad 100 includes, for example: after forming the structural part corresponding to the polishing track region A by a perfusion method, forming the structural part corresponding to the non-polishing track region B by the perfusion method. At this time, the structural part corresponding to the non-polishing track region B and the formed structural part corresponding to the polishing track region A are connected and integrated. In the polishing layer 102, a part that includes the first reactant 106*a* and the second reactant 106*b* and a part that does not include the first reactant 106*a* and the second reactant 106*b* are respectively combined and formed by the perfusion method, for example. However, the invention is not limited to the foregoing manufacturing method of the polishing pad 100, and the polishing pad 100 of the invention may also be manufactured by other manufacturing methods.

From another perspective, as shown in FIG. 2, in an embodiment, a cross-section of the polishing pad 100 includes the polishing layer 102 and a plurality of grooves 104 disposed in a polishing surface PS of the polishing layer 102, wherein the first reactant 106*a* and the second reactant 106*b* are distributed in the polishing layer 102, and when the polishing procedure is performed on the object using the polishing pad 100, the object is in contact with the polishing surface PS of the polishing layer 102. More specifically, in the present embodiment, each groove 104 has a groove depth D from the polishing surface PS, and the first reactant 106*a* and the second reactant 106*b* are distributed in the polishing layer 102 below D/2 from the polishing surface PS. In other words, the first reactant 106*a* and the second reactant 106*b* are not thoroughly distributed in the polishing layer 102 and are not distributed in the polishing surface PS of the polishing layer 102. In some embodiments, the first reactant 106*a* and the second reactant 106*b* are not disposed in the polishing surface PS so that scratch and deteriorated polishing quality can be avoided, because the object will not directly contact with the first reactant 106*a* and the second reactant 106*b* when the polishing procedure is performed on the object using the polishing pad 100.

In the embodiment of FIG. 2, although the first reactant 106*a* and the second reactant 106*b* in the polishing pad 100 are distributed in the polishing layer 102 below D/2 from the polishing surface PS, the invention is not limited hereto. The foregoing selections of the distribution and the distance from the polishing surface PS may be determined by wearing of the polishing layer 102 in the life-time of the polishing pad 100. In other embodiments, the first reactant 106*a* and the second reactant 106*b* may also be distributed in the polishing layer 102 below 2D/3, 3D/4, 4D/5, or D from the polishing surface PS so that scratch can be avoided, because the object will not directly contact with the first reactant 106*a* and the second reactant 106*b* in some embodiments. Moreover, in other embodiments, in some specific polishing processes, the object may not be easily scratched, or the first reactant 106*a* and the second reactant 106*b* that do not easily scratch the object are selected. In that case, the first reactant 106*a* and the second reactant 106*b* may be selected to be distributed in the entire polishing layer 102 of the polishing pad 100.

In addition, in the embodiment of FIG. 2, although the cross-section of the polishing pad 100 includes the plurality of grooves 104, the invention is not limited hereto. As long as the polishing pad 100 includes at least one groove 104, it falls in the scope of the invention. Furthermore, a shape of distribution of the grooves 104 is, for example, concentric circles, eccentric circles, ovals, polygonal rings, spiral rings, irregular rings, parallel lines, radiation shapes, radiation arcs, spirals, dots, XY lattices, polygonal lattices, irregular shapes, or a combination thereof, but the invention is not limited hereto.

It is noted that in the present embodiment, the polishing pad 100 satisfies the following condition: the first reactant 106*a*, which reacts endothermically with water, is disposed in the polishing track region A, and the second reactant 106*b*, which reacts exothermically with water, is disposed in the non-polishing track region B. Thereby, when the polishing procedure is performed on the object using the polishing pad 100, the temperature gradient of the polishing pad 100 reduces and the temperature distribution of the polishing pad 100 becomes more uniform for the following reasons.

In general polishing procedures, the main ingredients in various slurries used in the industry all include water. Therefore, during the polishing procedure performed on the object using the polishing pad 100, an endothermic reaction occurs when the water in the slurry contacts the first reactant 106*a* disposed in the polishing track region A through permeation, so as to absorb heat generated by mechanical friction between the object and the polishing surface PS in the polishing track region A, and thereby reducing the degree of temperature increase in the polishing track region A, for example, reducing by at least 0.5° C. (reducing by 1° C., 2° C., 4° C., 6° C., 8° C., or 10° C., for example, but the invention is not limited hereto); and an exothermic reaction occurs when the water in the slurry contacts the second reactant 106*b* disposed in the non-polishing track region B through permeation, thereby increasing the temperature in the non-polishing track region B, where mechanical friction with the object substantially does not occur, for example, increasing by at least 0.5° C. (increasing by 1° C., 2° C., 4° C., 6° C., 8° C., or 10° C., for example, but the invention is not limited hereto). Accordingly, compared with the conventional temperature distribution diagram as shown in FIG. 1, the temperature gradient which the temperature of the polishing track region A is higher than the temperature of the non-polishing track region B in the polishing pad 100 is reduced during the polishing procedure, so the temperature distribution of polishing pad 100 is more uniform.

Moreover, in the embodiment of FIG. 2, the polishing pad 100 simultaneously includes the first reactant 106*a* and the second reactant 106*b*, i.e., simultaneously satisfying the following conditions: (a) the first reactant 106*a* is disposed in the polishing track region A, wherein the first reactant 106*a* reacts endothermically with the water in the slurry, and (b) the second reactant 106*b* is disposed in the non-polishing track region B, wherein the second reactant 106*b* reacts exothermically with the water in the slurry. However, the invention is not limited hereto. In other embodiments, the polishing pad 100 may also satisfy only one of the foregoing conditions (a) and (b). In other words, the polishing pad 100 may include the first reactant 106*a* only or the second reactant 106*b* only. In that case, during the polishing procedure performed on the object using the polishing pad 100, since the degree of temperature increase caused by mechanical friction in the polishing track region A of the polishing pad 100 is reduced, or since the temperature in the non-polishing track region B of the polishing pad 100 increases, the temperature gradient of the polishing pad 100 is still reduced during the polishing procedure.

In the embodiment of FIG. 2, the polishing pad 100 includes the first reactant 106*a* and the second reactant 106*b* located in the polishing layer 102, but the invention is not limited hereto. In other embodiments, the first reactant and the second reactant included in the polishing pad may be located in other layers. Detailed description will be provided below with reference to FIG. 3.

Figure 3:
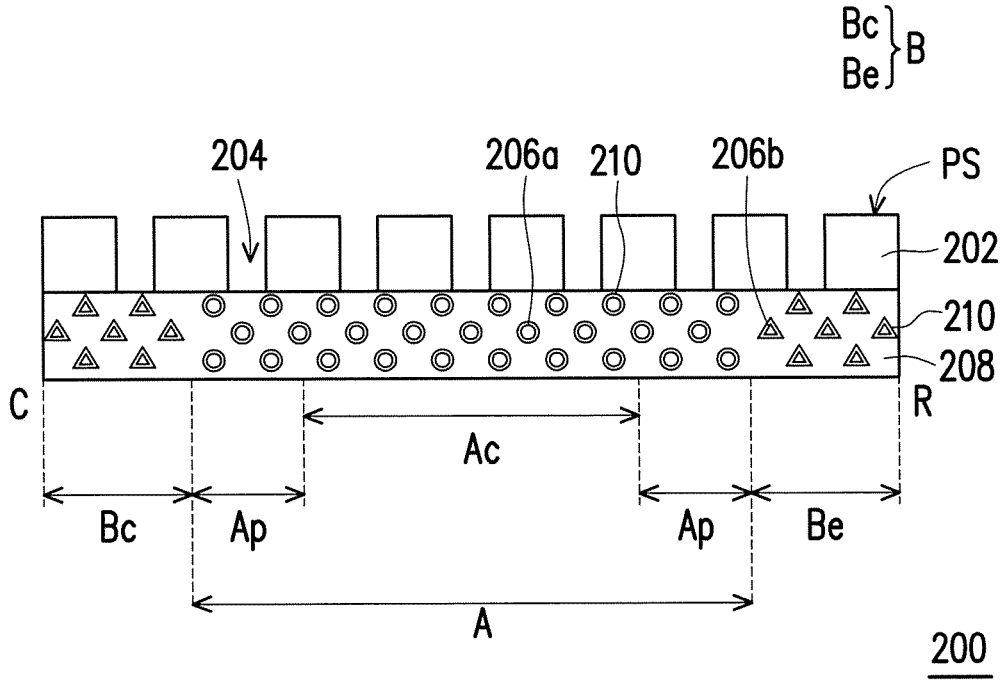
FIG. 3 is a cross-sectional schematic diagram illustrating a polishing pad along a radius direction according to another embodiment of the invention.

FIG. 3 is a cross-sectional schematic diagram illustrating a polishing pad according to another embodiment of the invention. Similarly, reference may be made to FIG. 1 for a top schematic diagram of a polishing pad 200 of FIG. 3. Moreover, referring to both FIG. 3 and FIG. 2, the polishing pad 200 of FIG. 3 and the polishing pad 100 of FIG. 2 are similar, so the same or similar components are labeled by the same or similar numerals, and relevant descriptions will not be repeated here. Differences between the two will be described below.

Referring to FIG. 3, the polishing pad 200 includes a polishing layer 202, a plurality of grooves 204 disposed in the polishing surface PS of the polishing layer 202, and a base layer 208 disposed under the polishing layer 202, wherein a first reactant 206*a* and a second reactant 206*b* are distributed in the base layer 208. It is noted that according to the needs, a cover layer 210 is selectively formed to cover the first reactant 206*a* and the second reactant 206*b*, wherein the cover layer 210 is used to prevent the first reactant 206*a* and the second reactant 206*b* from reacting with a precursor of the base layer 208 (i.e., a material for manufacturing the base layer 208), and the properties and the material of the cover layer 210 are as described for the cover layer 110 in the embodiment of FIG. 2 and will not be repeatedly described here. In the present embodiment, the base layer 208 is suitable for underlaying the polishing layer 202 in the polishing pad 200, and the material of the base layer 208 is, for example, polyurethane, polybutadiene, polyethylene, polypropylene, a copolymer of polyethylene and ethylene vinyl acetate, or a copolymer of polypropylene and ethylene vinyl acetate, but the invention is not limited hereto. Moreover, in the present embodiment, the grooves 204 expose the base layer 208.

It is noted that in the present embodiment, the polishing pad 200 satisfies the following condition: the first reactant 206*a*, which reacts endothermically with the water in the slurry, is disposed in the base layer 208 located within the polishing track region A, and the second reactant 206*b*, which reacts exothermically with the water in the slurry, is disposed in the base layer 208 located within the non-polishing track region B. As mentioned above, an endothermic reaction occurs when the water in the slurry contacts the first reactant 206*a* disposed in the polishing track region A through permeation, and an exothermic reaction occurs when the water in the slurry contacts the second reactant 206*b* disposed in the non-polishing track region B through permeation. Thereby, during the polishing procedure performed on the object using the polishing pad 200, the degree of temperature increase caused by mechanical friction in the polishing track region A is reduced, and the temperature in the non-polishing track region B increases. Accordingly, compared with the conventional temperature distribution diagram as shown in FIG. 1, the temperature gradient which the temperature of the polishing track region A is higher than the temperature of the non-polishing track region B in the polishing pad 200 is reduced during the polishing procedure, so the temperature distribution of polishing pad 200 is more uniform.

On the other hand, in the embodiment of FIG. 3, the polishing pad 200 simultaneously includes the first reactant 206*a* and the second reactant 206*b*, i.e., simultaneously satisfying the following conditions: (a) the first reactant 206*a* is disposed in the polishing track region A, wherein the first reactant 206*a* reacts endothermically with the water in the slurry, and (b) the second reactant 206*b* is disposed in the non-polishing track region B, wherein the second reactant 206*b* reacts exothermically with the water in the slurry. However, the invention is not limited hereto. In other embodiments, the polishing pad 200 may also satisfy only one of the foregoing conditions (a) and (b). In other words, the polishing pad 200 may include the first reactant 206*a* only or the second reactant 206*b* only. In that case, during the polishing procedure performed on the object using the polishing pad 200, since the degree of temperature increase caused by mechanical friction in the polishing track region A of the polishing pad 200 is reduced, or since the temperature in the non-polishing track region B of the polishing pad 200 increases, the temperature gradient of the polishing pad 200 is still reduced during the polishing procedure.

In addition, in the embodiments of FIG. 2 and FIG. 3 above, the polishing track region A is disposed with the first reactant (i.e. the first reactant 106*a*, the first reactant 206*a*) only, but the invention is not limited hereto. In other embodiments, the polishing track region of the polishing pad may also be disposed with the second reactant. Detailed description will be provided below with reference to FIG. 4 and FIG. 5.

Figure 4:
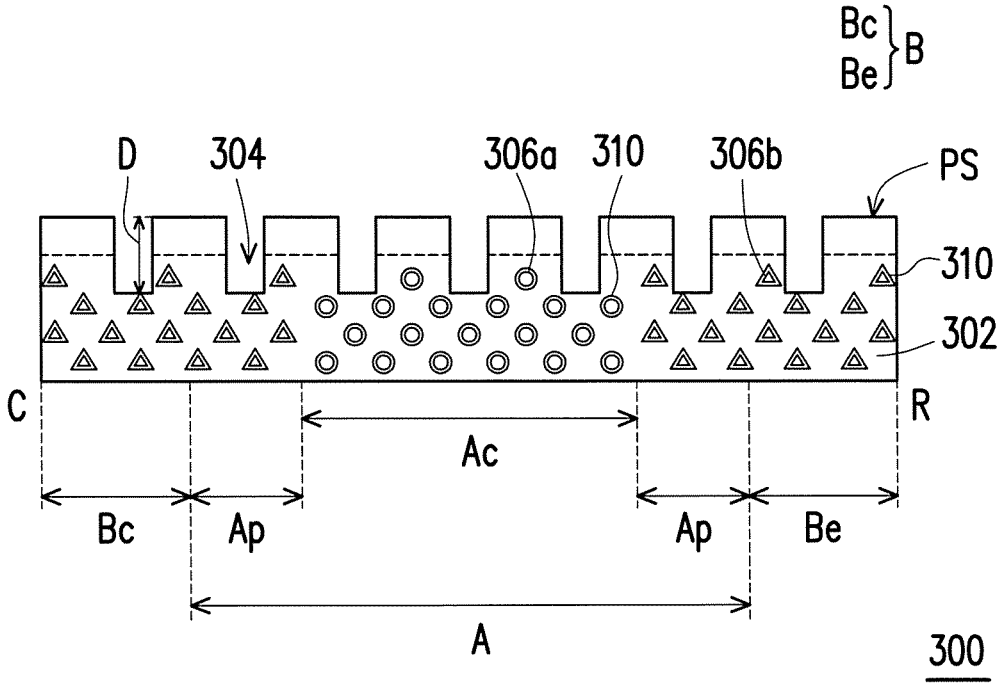
FIG. 4 is a cross-sectional schematic diagram illustrating a polishing pad along a radius direction according to another embodiment of the invention.

FIG. 4 is a cross-sectional schematic diagram illustrating a polishing pad according to another embodiment of the invention. Similarly, reference may be made to FIG. 1 for a top schematic diagram of a polishing pad 300 of FIG. 4. Moreover, referring to both FIG. 4 and FIG. 2, the polishing pad 300 of FIG. 4 and the polishing pad 100 of FIG. 2 are similar, so the same or similar components are labeled by the same or similar numerals, and relevant descriptions will not be repeated here. Differences between the two will be described below.

Referring to FIG. 4, in the present embodiment, a first reactant 306*a* and a second reactant 306*b* are distributed in a polishing layer 302, and the first reactant 306*a* is disposed in the central region Ac of the polishing track region A, and the second reactant 306*b* is disposed in the peripheral region Ap of the polishing track region A and the non-polishing track region B. In other words, in the present embodiment, the first reactant 306*a* is disposed in the central region Ac only, and the peripheral region Ap, the center region Bc, and the edge region Be are all disposed with the second reactant 306*b*. It is also noted that according to the needs, a cover layer 310 is selectively formed to cover the first reactant 306*a* and the second reactant 306*b*, wherein the cover layer 310 is used to prevent the first reactant 306*a* and the second reactant 306*b* from reacting with a precursor of the polishing layer 302 (i.e., a material for manufacturing the polishing layer 302), and the properties and the material of the cover layer 310 are as described for the cover layer 110 in the embodiment of FIG. 2 and will not be repeatedly described here.

It is noted that in the present embodiment, the polishing pad 300 satisfies the following condition: the first reactant 306*a*, which reacts endothermically with the water in the slurry, is disposed in the central region Ac of the polishing track region A, and the second reactant 306*b*, which reacts exothermically with the water in the slurry, is disposed in the peripheral region Ap of the polishing track region A and the non-polishing track region B. Thereby, when the polishing procedure is performed on the object using the polishing pad 300, the temperature gradient of the polishing pad 300 reduces and the temperature distribution of the polishing pad 300 becomes more uniform for the following reasons.

According to the conventional temperature distribution diagram obtained by performing the polishing procedure using the conventional polishing pad and illustrated in FIG. 1, the temperature corresponding to the central region Ac of the polishing track region A is not only higher than the temperature corresponding to the non-polishing track region B, but the temperature corresponding to the central region Ac of the polishing track region A is also higher than the temperature corresponding to the peripheral region Ap of the polishing track region A. Accordingly, during the polishing procedure performed on the object using the polishing pad 300, when the water in the slurry contacts the first reactant 306*a* disposed in the central region Ac through permeation, the heat generated by mechanical friction between the object and the polishing surface PS in the central region Ac would be absorbed, thereby reducing the degree of temperature increase in the central region Ac; and when the water in the slurry contacts the second reactant 306*b* disposed in the peripheral region Ap and the non-polishing track region B through permeation, heat would be released, thereby increasing the temperature in the peripheral region Ap and the non-polishing track region B. Accordingly, compared with the conventional temperature distribution diagram as shown in FIG. 1, the temperature gradient which the temperature of the central region Ac of the polishing track region A is higher than the temperature of the peripheral region Ap of the polishing track region A and the non-polishing track region B in the polishing pad 300 is reduced during the polishing procedure, so the temperature distribution of polishing pad 300 is more uniform.

In addition, in the embodiment of FIG. 4, although the non-polishing track region B of the polishing pad 300 is disposed with the second reactant 306*b*, the invention is not limited hereto. In other embodiments, the non-polishing track region B of the polishing pad 300 may not be disposed with the second reactant 306*b*. In other words, the second reactant 306*b* is disposed in the peripheral region Ap of the polishing track region A only, and the first reactant 306*a* is disposed in the central region Ac of the polishing track region A only. In that case, the polishing pad 300 satisfies the following conditions: (c) the first reactant 306*a* is disposed in the central region Ac of the polishing track region A, wherein the first reactant 306*a* reacts endothermically with the water in the slurry, and (d) the second reactant 306*b* is disposed in the peripheral region Ap of the polishing track region A, wherein the second reactant 306*b* reacts exothermically with the water in the slurry. Thereby, during the polishing procedure performed on the object using the polishing pad 300, since the degree of temperature increase caused by mechanical friction in the central region Ac of the polishing track region A is reduced, and the temperature in the peripheral region Ap of the polishing track region A increases, the temperature gradient of the polishing pad 300 is still reduced.

Furthermore, referring to the foregoing description of the embodiment of FIG. 2, since the polishing pad 300 may also include the first reactant 306*a* only or the second reactant 306*b* only, the polishing pad 300 may also satisfy only one of the foregoing conditions (c) and (d). In other words, the polishing pad 300 may include the first reactant 306*a* only or the second reactant 306*b* only. In that case, during the polishing procedure performed on the object using the polishing pad 300, since the degree of temperature increase caused by mechanical friction in the central region Ac of the polishing track region A of the polishing pad 300 is reduced, or since the temperature in the peripheral region Ap of the polishing track region A of the polishing pad 300 increases, the temperature gradient of the polishing pad 300 is still reduced.

It is also noted that in the embodiment of FIG. 4, although the polishing pad 300 simultaneously includes the polishing track region A and the non-polishing track region B, in some embodiments, the polishing pad 300 may also not include the non-polishing track region B, i.e., the polishing track region A covers the entire polishing pad 300. For example, when a polishing condition of a machine table sets the polishing track region A to cover the entire polishing pad 300, or when the object is oscillated inwards and outwards on the polishing pad 300 in addition to rotation on the polishing pad 300 during the polishing procedure, the polishing track region A covers the entire polishing pad 300. In that case, as mentioned above, with the polishing pad 300 satisfying at least one of the foregoing conditions (c) and (d), when the polishing procedure is performed on the object using the polishing pad 300, the temperature gradient of the polishing pad 300 is still reduced.

In the embodiment of FIG. 4, the first reactant 306*a* and the second reactant 306*b* of the polishing pad 300 are located in the polishing layer 302, but the invention is not limited hereto. In other embodiments, the first reactant and the second reactant included in the polishing pad may be located in other layers. Detailed description will be provided below with reference to FIG. 5.

Figure 5:
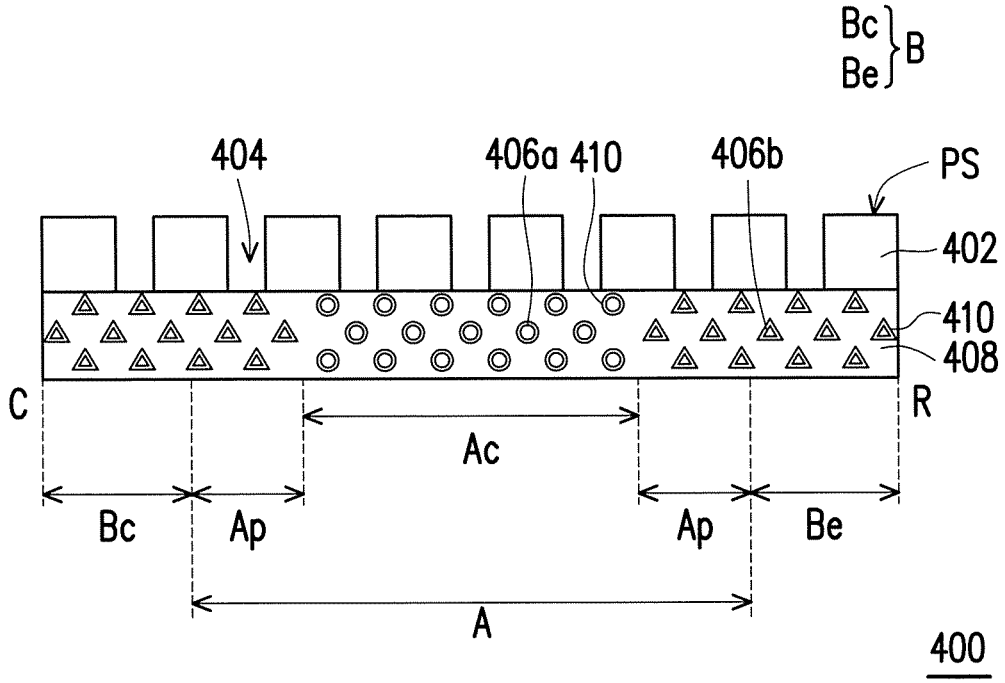
FIG. 5 is a cross-sectional schematic diagram illustrating a polishing pad along a radius direction according to another embodiment of the invention.

FIG. 5 is a cross-sectional schematic diagram illustrating a polishing pad according to another embodiment of the invention. Similarly, reference may be made to FIG. 1 for a top schematic diagram of a polishing pad 400 of FIG. 5. Moreover, referring to FIG. 5 and FIGS. 3, 4, the polishing pad 400 of FIG. 5 and the polishing pad 200 of FIG. 3 and the polishing pad 300 of FIG. 4 are similar, so the same or similar components are labeled by the same or similar numerals, and relevant descriptions will not be repeated here. Differences between them will be described below.

Referring to FIG. 5, a cross-section of the polishing pad 400 includes a polishing layer 402, a plurality of grooves 404 disposed in the polishing surface PS of the polishing layer 402, and a base layer 408 disposed under the polishing layer 402, wherein a first reactant 406*a* and a second reactant 406*b* are distributed in the base layer 408. It is also noted that according to the needs, a cover layer 410 is selectively formed to cover the first reactant 406*a* and the second reactant 406*b*, wherein the cover layer 410 is used to prevent the first reactant 406*a* and the second reactant 406*b* from reacting with a precursor of the base layer 408 (i.e., a material for manufacturing the base layer 408), and the properties and the material of the cover layer 410 are as described for the cover layer 110 in the embodiment of FIG. 2 and will not be repeatedly described here. In the present embodiment, the base layer 408 is suitable for underlaying the polishing layer 402 in the polishing pad 400, and the material of the base layer 408 is, for example, polyurethane, polybutadiene, polyethylene, polypropylene, a copolymer of polyethylene and ethylene vinyl acetate, or a copolymer of polypropylene and ethylene vinyl acetate, but the invention is not limited hereto. Moreover, in the present embodiment, the grooves 404 expose the base layer 408.

It is noted that in the present embodiment, the polishing pad 400 satisfies the following condition: the first reactant 406*a*, which reacts endothermically with the water in the slum', is disposed in the base layer 408 located within the central region Ac of the polishing track region A, and the second reactant 406*b*, which reacts exothermically with the water in the slurry, is disposed in the base layer 408 located within the peripheral region Ap of the polishing track region A and the non-polishing track region B. Referring to the foregoing description of the embodiment of FIG. 4, an endothermic reaction occurs when the water in the slurry contacts the first reactant 406*a* disposed in the central region Ac of the polishing track region A through permeation, and an exothermic reaction occurs when the water in the slurry contacts the second reactant 406*b* disposed in the peripheral region Ap of the polishing track region A and the non-polishing track region B through permeation. Thereby, during the polishing procedure performed on the object using the polishing pad 400, the degree of temperature increase caused by mechanical friction in the central region Ac is reduced, and the temperature in the peripheral region Ap of the polishing track region A and the non-polishing track region B increases. Accordingly, compared with the conventional temperature distribution diagram as shown in FIG. 1, he temperature gradient which the temperature of the central region Ac of the polishing track region A is higher than the temperature of the peripheral region Ap of the polishing track region A and the non-polishing track region B in the polishing pad 400 is reduced during the polishing procedure, so the temperature distribution of polishing pad 400 is more uniform.

In addition, in the embodiment of FIG. 5, although the non-polishing track region B of the polishing pad 400 is disposed with the second reactant 406*b*, the invention is not limited hereto. In other embodiments, the non-polishing track region B of the polishing pad 400 may not be disposed with the second reactant 406*b*. In otherwords, the second reactant 406*b* is only disposed in the peripheral region Ap of the polishing track region A, and the first reactant 406*a* is only disposed in the central region Ac of the polishing track region A. In that case, the polishing pad 400 satisfies the following conditions: (c) the first reactant 406*a* is disposed in the central region Ac of the polishing track region A, wherein the first reactant 406*a* reacts endothermically with the water in the slurry, and (d) the second reactant 406*b* is disposed in the peripheral region Ap of the polishing track region A, wherein the second reactant 406*b* reacts exothermically with the water in the slung. Thereby, during the polishing procedure performed on the object using the polishing pad 400, since the degree of temperature increase caused by mechanical friction in the central region Ac of the polishing track region A is reduced, and the temperature in the peripheral region Ap of the polishing track region A increases, the temperature gradient of the polishing pad 400 is still reduced.

Furthermore, referring to the foregoing description of the embodiment of FIG. 2, since the polishing pad 400 may also include the first reactant 406*a* only or the second reactant 406*b* only, the polishing pad 400 may also satisfy only one of the foregoing conditions (c) and (d). In other words, the polishing pad 400 may include the first reactant 406*a* only or the second reactant 406*b* only. In that case, during the polishing procedure performed on the object using the polishing pad 400, since the degree of temperature increase caused by mechanical friction in the central region Ac of the polishing track region A of the polishing pad 400 is reduced, or since the temperature in the peripheral region Ap of the polishing track region A of the polishing pad 400 increases, the temperature gradient of the polishing pad 400 is still reduced.

The polishing pad of the invention is not limited to the foregoing description. For different polishing processes, in an embodiment, the polishing pad may be selected to include the first reactant which reacts endothermically with water in a specific region, and include the second reactant which reacts exothermically with water in another specific region, so that the temperature distribution of the polishing pad can be changed during the polishing procedure. Moreover, for other different polishing processes, in other embodiments, the first reactant which reacts endothermically with water may also be selected to be included in the entire region of the polishing pad, such that the temperature of the entire region of the polishing pad can be reduced during the polishing procedure; alternatively, the second reactant which reacts exothermically with water may also be selected to be included in the entire region of the polishing pad, such that the temperature of the entire region of the polishing pad can be increased during the polishing procedure. Thereby, the temperature distribution of the polishing pad can be changed during the polishing procedure. In other words, the polishing pad satisfies at least one of the following conditions: (e) the first reactant is disposed in polishing pad, and the first reactant reacts endothermically with the water in the slurry, and (f) the second reactant is disposed in the polishing pad, and the second reactant reacts exothermically with the water in the slurry. Since the polishing pad of the invention is applicable to any polishing procedure using a slurry containing water, the selection of the slurry is not specifically limited. Accordingly, the polishing pad may be directly applied in the existing polishing process, and thereby without need to add or modify any equipment and without limitation on the combination and selection of the slurry, the temperature gradient of the polishing pad is reduced or the temperature distribution of the polishing pad is changed during the polishing procedure. Therefore, the polishing pad of the invention exhibits excellent industrial applicability.

Figure 6:
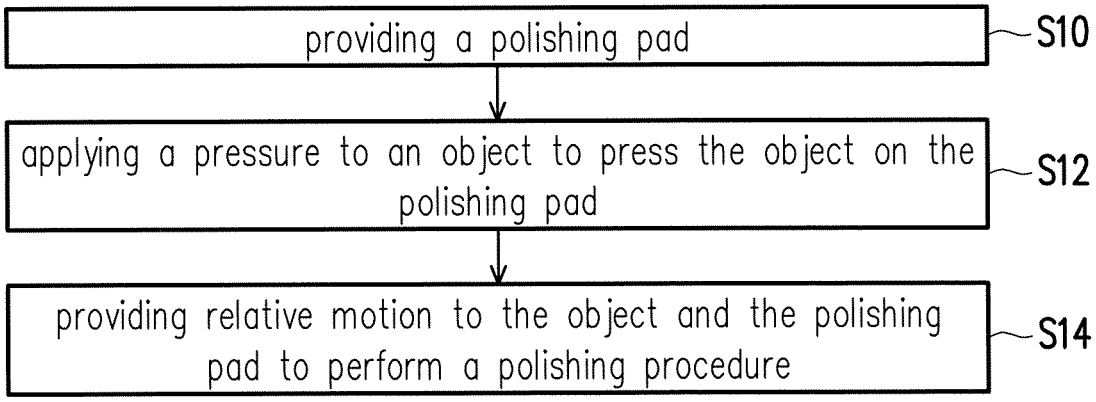
FIG. 6 is a flowchart illustrating a polishing method according to an embodiment of the invention.

FIG. 6 is a flowchart illustrating a polishing method according to an embodiment of the invention. The polishing method is suitable for polishing an object. Specifically, the polishing method may be applied to a polishing process for manufacturing an industrial device, such as a device used in the electronic industries including semiconductor devices, integrated circuits, micro-electromechanical devices, energy conversion devices, communication devices, optical devices, disks for storage, and displays etc., and objects used for manufacturing the devices may include semiconductor wafers, Group III-V wafers, carriers of storage devices, ceramic substrates, polymer substrates, and glass substrates, etc. However, the invention is not limited hereto.

Referring to FIG. 6, first, in step S10, a polishing pad is provided. Specifically, in the present embodiment, the polishing pad may be any type of polishing pads as described in the foregoing embodiments, e.g., the polishing pad 100, 200, 300, or 400. Relevant descriptions of the polishing pads 100, 200, 300, and 400 have been detailed above and thus will not be repeated here.

Then, in step S12, a pressure is applied to an object. Thereby, the object is pressed on the polishing pad and is in contact with the polishing pad. Specifically, as described above, the object is in contact with the polishing surface PS of the polishing layer 102, 202, 302, or 402. Moreover, the method of applying the pressure to the object is performed by using a carrier that can hold the object, for example.

Afterwards, in step S14, relative motion is provided to the object and the polishing pad, so as to perform a polishing procedure on the object using the polishing pad and achieve the purpose of planarization. Specifically, the method of providing the relative motion to the object and the polishing pad is, for example: rotating the polishing pad fixed on a platen via rotation of the platen.

It is noted that the wording "the first reactant and the second reactant" mentioned in the conditions in the invention is meant to facilitate illustration and is not meant to limit the invention. The conditions of the invention further include "the first reactant or the second reactant" or "the first reactant and/or the second reactant".

Although the invention is disclosed as the embodiments above, the embodiments are not meant to limit the invention. Any person skilled in the art may make slight modifications and variations without departing from the spirit and scope of the invention. Therefore, the protection scope of the invention shall be defined by the claims attached below.

What is claimed is:

1. A polishing pad suitable for a polishing procedure using a slurry containing water, the polishing pad comprising:

a polishing track region comprising a central region and a peripheral region surrounding the central region; and a first reactant disposed in the central region of the polishing track region, wherein the first reactant reacts endothermically with the water in the slurry.

2. The polishing pad according to claim 1, wherein the first reactant comprises $NH_4NO_3$, $NH_4Cl$, urea, or xylitol.

3. The polishing pad according to claim 1, further comprising a second reactant disposed in the peripheral region of the polishing track region, wherein the second reactant reacts exothermically with the water in the slurry.

4. The polishing pad according to claim 3, wherein the second reactant comprises CaO, $CaC_2$, ethanol, or glycerol.

5. The polishing pad according to claim 1, wherein the first reactant is further disposed in the peripheral region of the polishing track region.

6. The polishing pad according to claim 1, further comprising a non-polishing track region comprising a center region, an edge region, or a combination thereof, wherein the center region is located on an inner side of the polishing track region, and the edge region is located on an outer side of the polishing track region.

7. The polishing pad according to claim 6, further comprising a second reactant disposed in the non-polishing track region, wherein the second reactant reacts exothermically with the water in the slurry.

8. The polishing pad according to claim 7, wherein the second reactant comprises CaO, $CaC_2$, ethanol, or glycerol.

9. A polishing pad suitable for a polishing procedure using a slurry containing water, the polishing pad comprising:

a polishing track region and a non-polishing track region, wherein the polishing pad satisfies at least one of the following conditions:

(a) a first reactant is disposed in the polishing track region, wherein the first reactant reacts endothermically with the water in the slum', and (b) a second reactant is disposed in the non-polishing track region, wherein the second reactant reacts exothermically with the water in the slurry.

10. The polishing pad according to claim 9, wherein the non-polishing track region comprises a center region, an edge region, or a combination thereof, wherein the center region is located on an inner side of the polishing track region, and the edge region is located on an outer side of the polishing track region.

11. The polishing pad according to claim 9, wherein the first reactant comprises $NH_4NO_3$, $NH_4Cl$, urea, or xylitol.

12. The polishing pad according to claim 9, wherein the second reactant comprises CaO, $CaC_2$, ethanol, or glycerol.

13. The polishing pad according to claim 9, further comprising a polishing layer, wherein the first reactant or the second reactant is distributed in the polishing layer.

14. The polishing pad according to claim 13, further comprising at least one groove disposed in a polishing surface of the polishing layer, wherein the at least one groove has a groove depth D from the polishing surface, and the first reactant or the second reactant is distributed in the polishing layer below D/2, 2D/3, 3D/4, 4D/5, or D from the polishing surface.

15. The polishing pad according to claim 9, further comprising a polishing layer and a base layer, wherein the base layer is disposed under the polishing layer, and the first reactant or the second reactant is distributed in the base layer.

16. The polishing pad according to claim 9, further comprising a cover layer covering the first reactant or the second reactant.

17. The polishing pad according to claim 16, wherein a material of the cover layer comprises a water-soluble material, a water-absorbing material, or a water-permeable material.

18. A polishing pad suitable for a polishing procedure using a slurry containing water, the polishing pad comprising:

a polishing track region comprising a central region and a peripheral region surrounding the central region, wherein the polishing pad satisfies at least one of the following conditions:

(c) a first reactant is disposed in the central region of the polishing track region, wherein the first reactant reacts endothermically with the water in the slurry, and (d) a second reactant is disposed in the peripheral region of the polishing track region, wherein the second reactant reacts exothermically with the water in the slung.

19. The polishing pad according to claim 18, further comprising a non-polishing track region comprising a center region, an edge region, or a combination thereof, wherein the center region is located on an inner side of the polishing track region, and the edge region is located on an outer side of the polishing track region.

20. The polishing pad according to claim 19, wherein the second reactant is further disposed in the non-polishing track region.

21. The polishing pad according to claim 18, wherein the first reactant comprises $NH_4NO_3$, $NH_4Cl$, urea, or xylitol.

22. The polishing pad according to claim 18, wherein the second reactant comprises CaO, $CaC_2$, ethanol, or glycerol.

23. The polishing pad according to claim 18, further comprising a polishing layer, wherein the first reactant or the second reactant is distributed in the polishing layer.

24. The polishing pad according to claim 23, further comprising at least one groove disposed in a polishing surface of the polishing layer, wherein the at least one groove has a groove depth D from the polishing surface, and the first reactant or the second reactant is distributed in the polishing layer below D/2, 2D/3, 3D/4, 4D/5, or D from the polishing surface.

25. The polishing pad according to claim 18, further comprising a polishing layer and a base layer, wherein the base layer is disposed under the polishing layer, and the first reactant or the second reactant is distributed in the base layer.

26. The polishing pad according to claim 18, further comprising a cover layer covering the first reactant or the second reactant.

27. The polishing pad according to claim 26, wherein a material of the cover layer comprises a water-soluble material, a water-absorbing material, or a water-permeable material.

28. A polishing pad suitable for a polishing procedure using a slurry containing water, the polishing pad satisfying at least one of the following conditions:

(e) a first reactant is disposed in the polishing pad, wherein the first reactant reacts endothermically with the water in the slurry, and (f) a second reactant is disposed in the polishing pad, wherein the second reactant reacts exothermically with the water in the slurry.

29. The polishing pad according to claim 28, wherein the first reactant comprises $NH_4NO_3$, $NH_4Cl$, urea, or xylitol.

30. The polishing pad according to claim 28, wherein the second reactant comprises CaO, $CaC_2$, ethanol, or glycerol.

31. The polishing pad according to claim 28, further comprising a polishing track region and a non-polishing track region, wherein the polishing track region comprises a central region and a peripheral region surrounding the central region, and the non-polishing track region comprises a center region, an edge region, or a combination thereof, wherein the center region is located on an inner side of the polishing track region, and the edge region is located on an outer side of the polishing track region.

32. The polishing pad according to claim 31, wherein the first reactant is disposed in the polishing track region, and the second reactant is disposed in the non-polishing track region.

33. The polishing pad according to claim 31, wherein the first reactant is disposed in the central region of the polishing track region, and the second reactant is disposed in the peripheral region of the polishing track region.

34. The polishing pad according to claim 33, wherein the second reactant is further disposed in the non-polishing track region.

35. The polishing pad according to claim 28, further comprising a polishing layer, wherein the first reactant or the second reactant is distributed in the polishing layer.

36. The polishing pad according to claim 35, further comprising at least one groove disposed in a polishing surface of the polishing layer, wherein the at least one groove has a groove depth D from the polishing surface, and the first reactant or the second reactant is distributed in the polishing layer below D/2, 2D/3, 3D/4, 4D/5, or D from the polishing surface.

37. The polishing pad according to claim 28, further comprising a polishing layer and a base layer, wherein the base layer is disposed under the polishing layer, and the first reactant or the second reactant is distributed in the base layer.

38. The polishing pad according to claim 28, further comprising a cover layer covering the first reactant or the second reactant.

39. The polishing pad according to claim 38, wherein a material of the cover layer comprises a water-soluble material, a water-absorbing material, or a water-permeable material.

40. A polishing method suitable for polishing an object, the polishing method comprising:

providing a polishing pad, wherein the polishing pad is the polishing pad according to claim 1;

applying a pressure to the object to press the object on the polishing pad; and providing relative motion to the object and the polishing pad to perform the polishing procedure.

41. A polishing method suitable for polishing an object, the polishing method comprising:

providing a polishing pad, wherein the polishing pad is the polishing pad according to claim 9;

applying a pressure to the object to press the object on the polishing pad; and providing relative motion to the object and the polishing pad to perform the polishing procedure.

42. A polishing method suitable for polishing an object, the polishing method comprising:

providing a polishing pad, wherein the polishing pad is the polishing pad according to claim 18;

applying a pressure to the object to press the object on the polishing pad; and providing relative motion to the object and the polishing pad to perform the polishing procedure.

43. A polishing method suitable for polishing an object, the polishing method comprising:

providing a polishing pad, wherein the polishing pad is the polishing pad according to claim 28;

applying a pressure to the object to press the object on the polishing pad; and providing relative motion to the object and the polishing pad to perform the polishing procedure.

* * * * *